United States Patent [19]

Telesco

[11] Patent Number: 4,617,215

[45] Date of Patent: Oct. 14, 1986

[54] PLACE MAT

[76] Inventor: Barbara Telesco, P.O. Box 4035, Milford, Conn. 06460

[21] Appl. No.: 678,350

[22] Filed: Dec. 5, 1984

[51] Int. Cl.[4] ..... B65D 3/02

[52] U.S. Cl. ..... 428/43; 40/360; 283/51; 283/56; 283/105; D6/616; D20/27

[58] Field of Search ..... 428/43; 40/360; D6/613, D6/614, 615, 616; 283/51, 56, 52, 48 R, 103, 105; D20/19, 27, 40

[56] References Cited

U.S. PATENT DOCUMENTS

| | | | |
|---|---|---|---|
| D. 161,572 | 1/1951 | Davis | D6/616 |
| 737,049 | 10/1903 | Walker | 283/51 |
| 893,096 | 7/1908 | Phlegar | 283/56 |
| 1,280,548 | 10/1918 | Reynolds | 283/105 |
| 4,457,964 | 7/1984 | Kaminstein | 428/43 |

OTHER PUBLICATIONS

Advertising flyer for magazine subscriptions.

*Primary Examiner*—John E. Kittle
*Attorney, Agent, or Firm*—Arthur T. Fattibene

[57] ABSTRACT

A place mat formed of a blank of sheet paper-like material having a main indicia disposed on one side of the blank of sheet material and which blank is provided with a plurality of spaced apart easy tear or frangible lines circumscribing the main indicia. The tear lines define a plurality of separate and distinct portions, each of which can be readily separated from the blank and from each other, and each such distinct portion is provided with a secondary indicia thereon.

1 Claim, 1 Drawing Figure

PLACE MAT

FIELD OF INVENTION

Figure 1:
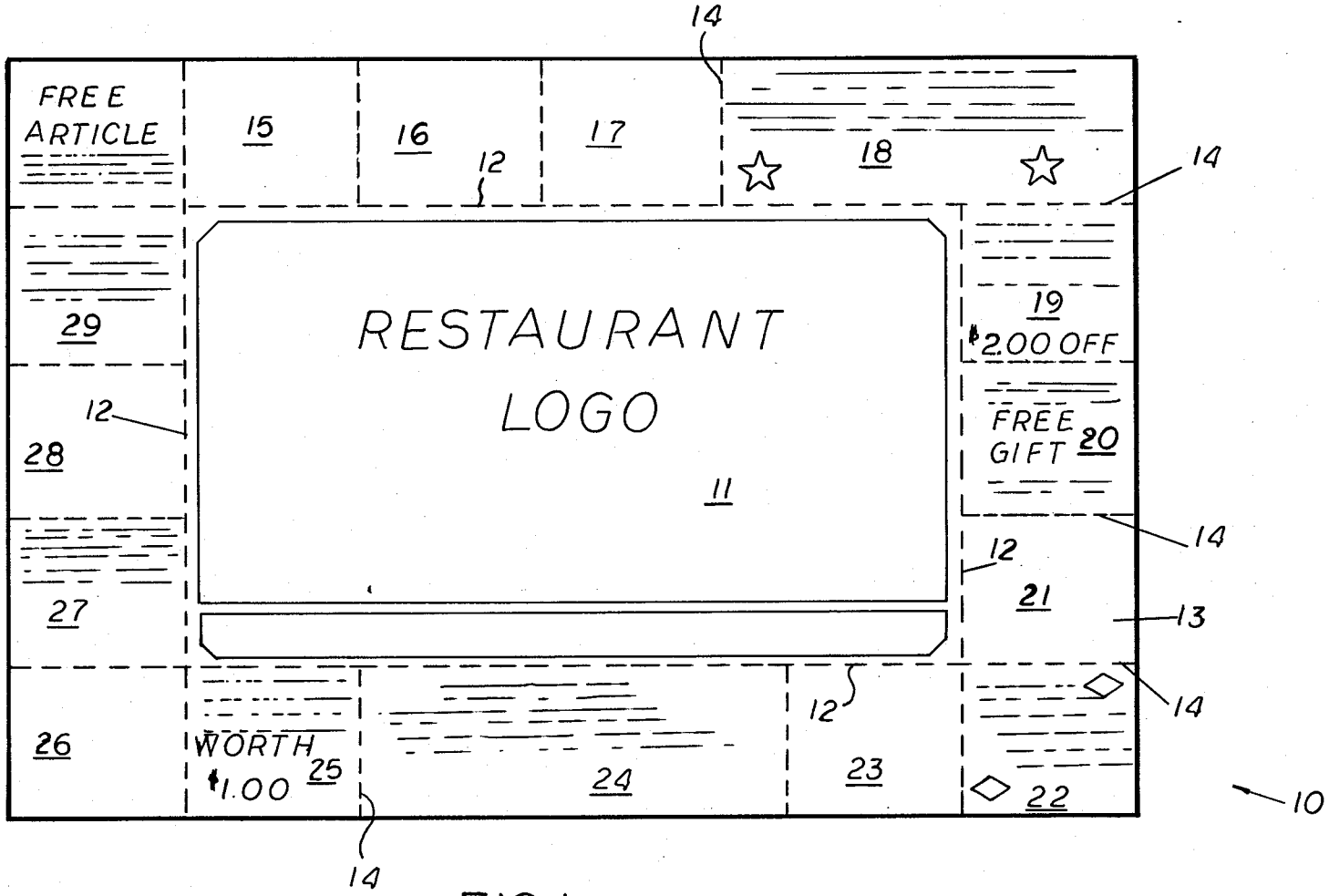

This invention relates to a novel place mat, generally formed of a paper stock material for use as a place setting in a commercial type restaurant or the like; and which placemat is constructed in a manner whereby the place mat may be used as an advertising device to enhance the sale of the products of another.

PRIOR ART

Heretofore, it has been known to use place mats as a table setting for use both in private homes, as well as commercial eating establishments. However, the known place mats were functional simply for use as a place mat, and had no other function. Such prior known place mats are evidenced in U.S. Pat. Nos. D-35010 directed to a paper doily, or DES 266,045 directed to a novelty type place mat. Other place mats are known which have markings thereon to provide amusement and/or games thereon, generally to occupy one's time while awaiting service such as disclosed in U.S. Pat. No. DES 161,572. Various known advertising devices are also known to enhance the sale of products of another, such as U.S. Pat. Nos. 1,543,414; 1,731,693; 1,556,515; 4,195,864; 4,097,067; 4,378,391 and 3,582,111. These latter devices disclose various arrangements for advertising the products of others which function as an inset having detachable coupons, and/or function as a tabulating device, or coupon or premium check and the like. These latter known advertising devices also were unitary in function and which construction did not make them suitable for a place mat.

OBJECTS

It is an object of this invention to provide a placemat which can be used as a place mat for a table setting, and which place mat can be also used as a device for advertising and/or selling the products of others without detracting from its use as a place mat.

Another object is to provide a place mat having a plurality of positively connected discrete portions which can be readily separated from the remainder portion of the place mat for use as a coupon.

Another object is to provide for a novel place mat that is relatively simple in construction, and which can function both as a place mat and as a device for enhancing the sale of the goods and services of others.

SUMMARY OF THE INVENTION

The foregoing objects and other features and advantages are provided by a place mat construction formed of a single blank of sheet material formed of paper or the like on which there is formed on at least one side thereof, a suitable indicia or logo. Surrounding the indicia and extending radially therefrom are a plurality of easy tear lines to define a plurality of separate and distinct portions of the blank on which a secondary or other indicia is provided to advertise the goods or services of another. The tear lines are constructed so as to be readily frangible so that the discrete or distinct portions can be readily separated from the remainder of the blank at the will of the user thereof.

FEATURES

A feature of this invention is to provide a place mat which has a plurality of distinct portions which can be readily separated from the whole, whereby the separated portion may function as a coupon or premium.

Another feature is to provide a place mat having a series of easy tear or score lines arranged thereon to define a plurality of smaller portions which can be readily separated from the whole.

Other features and advantages will become more readily apparent when considered in view of the drawing in which:

FIG. 1 is a plan view of a place mat embodying the invention.

DETAIL DESCRIPTION

Referring to the Drawing, there is illustrated a place mat 10 embodying the invention. As shown, the place mat 10 may be formed of any suitable material, e.g. paper, paper board, or other relatively inexpensive and readily disposable material. In the illustrated embodiment, the place mat is constructed primarily for use in a commercial eating establishment. Accordingly, the place mat is provided, as for example in a centrally located position on one side thereof, with the name and/or logo of a particular restaurant for whose use the place mat 10 is intended as indicated at 11. The logo, or restaurant name, is circumscribed by a score line or easy tear line, e.g. performations 12. Between the circumscribing tear line 12 and the free edges of the blank or sheet 10, there is defined a marginal portion 13. Extending transversely of the marginal portion 13 are a plurality of spaced apart easy tear lines 14, which may also comprise a series of perforations. As shown, the respective tears 14 define therebetween a plurality of separate and distinct portions 15, 16, 17, 18 to 29. Each such portion 15 to 29 is provided with secondary or other indicia as indicated to advertise the goods and services of others, and/or to function as coupons as indicated.

With the construction described, it will be apparent that each portion 15–29 is rendered readily detachable from the whole or remainder of the place mat 10. Accordingly, if a patron has an interest in any one of the several products or goods advertised on the respective portions 15 to 29, the patron can readily separate such portion from the remainder of the place mat upon completion of the meal. As evidenced in FIG. 1, the readily severable portions may also function as a coupon; which may be redeemed according to advertisers' instructions.

Accordingly, the construction of the place mat 10 is such that it not only functions as a place mat for a table setting in a restaurant or the like displaying the logo or advertisement of the host establishment, but that it also functions as a means for advertising the products of others and enables discrete portions thereof to be used as redeemable coupons, at the will and/or desire of the patron.

It will be understood that the logo and/or other indicia can be readily imprinted thereon in any suitable manner; and/or arranged thereon in arrangements other than illustrated.

While the invention has been disclosed with respect to a particular embodiment thereof, variations and modifications may be made without departing from the spirit or scope of the invention.

What is claimed is:

1. A placemat for a single setting of dishes and silver at mealtime comprising a blank of sheet material formed of plain disposable paper stock having an undersurface portion, and an upper surface, indicia means disposed on said upper surface, and said under surface being formed of said plain paper stock enabling said sheet material to be placed onto a supporting surface so as to be readily removable therefrom, said indicia means including a main indicia portion spaced inwardly from the peripheral portions of said sheet material to define a circumscribing marginal portion disposed about said main indicia portion, an easy tear line means circumscribing the periphery of said main indicia portion, and a plurality of spaced apart tear lines extending transversely of said marginal portion circumscribing said main indicia portion, said plurality of spaced apart tear lines extending normal to and between said first mentioned tear line and the outer periphery of said sheet material, said plurality of tear lines dividing said marginal portion into a single row of a plurality of serially connected contiguous separable and distinct portions, each of said separable and distinct portions having an edge portion coincidental with said outer peripheral portion of said sheet material whereby each of said separable and distinct portions can be readily separated from said blank of sheet material along the adjacent tear lines defining said separable and distinct portions without disturbing or separating any other of said separable marginal portions, and secondary indicia means disposed on each of said separable and distinct marginal portions.

* * * * *